US005244299A

United States Patent [19]

Chu

[11] Patent Number: 5,244,299

[45] Date of Patent: Sep. 14, 1993

[54] APPARATUS USED IN WRITING AND MASSAGING ALTERNATIVELY

[76] Inventor: Wei Y. Chu, B1, 12, Lane 135, Jui An Street, Taipei, Taiwan

[21] Appl. No.: 986,442

[22] Filed: Dec. 4, 1992

[51] Int. Cl.[5] ..... B43K 29/00; A61H 1/00

[52] U.S. Cl. ..... 401/195; 401/52; 128/41

[58] Field of Search ..... 401/195, 52; 128/34–37, 41–43

[56] References Cited

U.S. PATENT DOCUMENTS 3,390,460 7/1968 Brown et al. ..... 401/195 X
4,643,207 2/1987 Grahame ..... 132/73.6
4,825,853 5/1989 Iwamoto et al. ..... 128/34 X
5,164,814 11/1992 Buda ..... 401/195

*Primary Examiner*—Danton D. DeMille

[57] ABSTRACT

An apparatus is disposed for use in writing and massaging, including a pen unit to hold a replaceable refill, a bottom cap covered on the pen unit at the bottom and having a stimulating ball for spot massaging, a lower barrel attached to the pen unit at the top to hold a battery, an upper barrel attached to the lower barrel at the top to hold a motor and eccentric wheel assembly, and a top cap covered on the upper barrel at the top. The upper barrel and the top cap have pins on the outside vibrated by the eccentric wheel for massaging part of the body. A clip is made on the upper barrel for hanging.

1 Claim, 3 Drawing Sheets

APPARATUS USED IN WRITING AND MASSAGING ALTERNATIVELY

BACKGROUND OF THE INVENTION

The present invention relates to a pen which has a massaging mechanism incorporated thereto and controlled for rubbing and kneading the muscles and joints of part of the body.

In the interest of stimulating circulation and making muscles or joints supple, a variety of massaging devices have been proposed, and have appeared on the market. Regular massaging devices are commonly heavy and expensive and not convenient to carry with oneself as a personal item, and therefore their utilization is restricted.

SUMMARY OF THE INVENTION

One object of the present invention is to provide an apparatus which can be used in writing as well as massaging. Another object of the present invention is to provide an apparatus for use in writing as well as massaging which is suitable for mass production. Still another object of the present invention is to provide an apparatus for writing and massaging which uses a replaceable refill for writing. Still another object of the present invention is to provide an apparatus for writing and massaging which is compact and has a clip for fastening to one's pocket. Still another object of the present invention is to provide an apparatus for writing and massaging which has different massaging elements vibrated in horizontal or vertical direction for massaging different parts of the body. Still another object of the present invention is to provide an apparatus for writing and massaging which has a stimulating ball for spot massaging.

DETAILED DESCRIPTION OF THE PREFERRED EMBODIMENT

Figure 1:
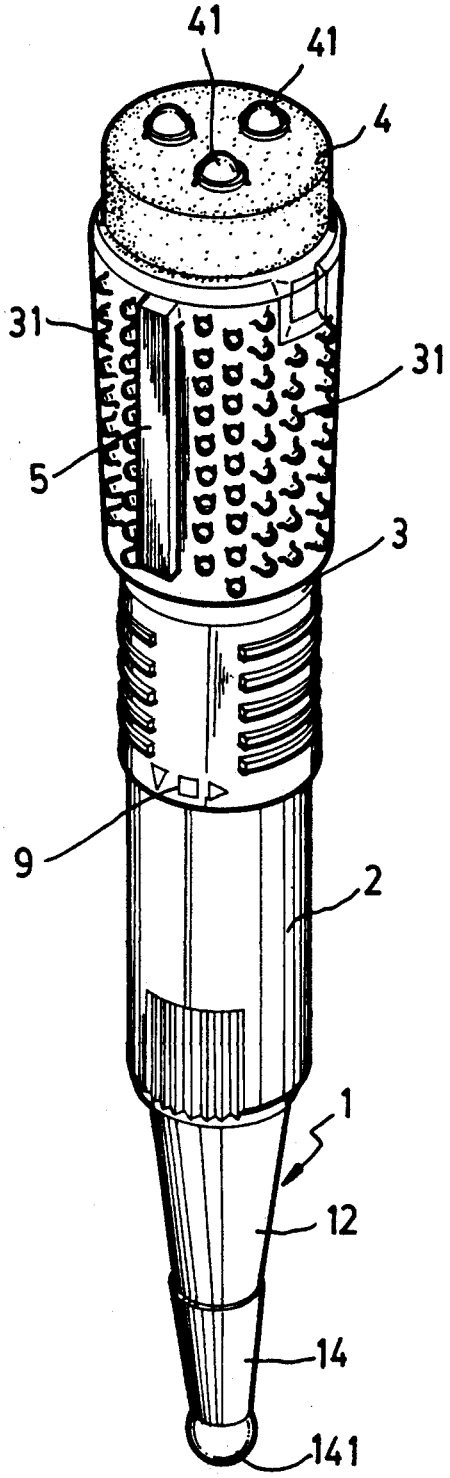
FIG. 1 is an elevational view of the preferred embodiment of the present invention.

Referring to FIG. 1, therein illustrated is the preferred embodiment of the present invention which is generally comprised of a pen unit 1, a lower barrel 2, a rotary upper barrel 3, and a top cap 4. The rotary upper barrel 3 has a clip 5 for fastening to a pocket or the like.

Figure 2:
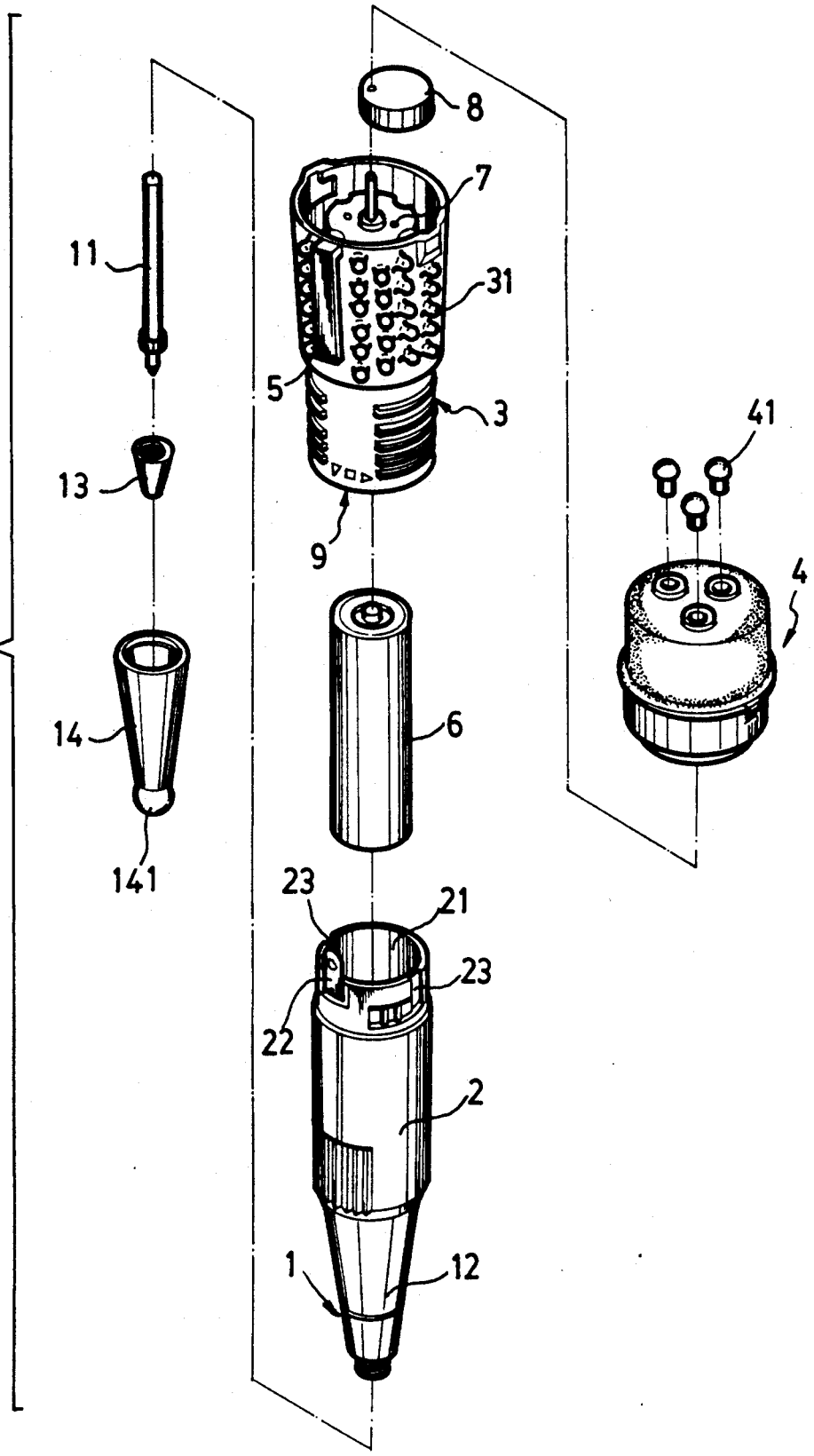
FIG. 2 is an exploded view thereof.
Figure 3:
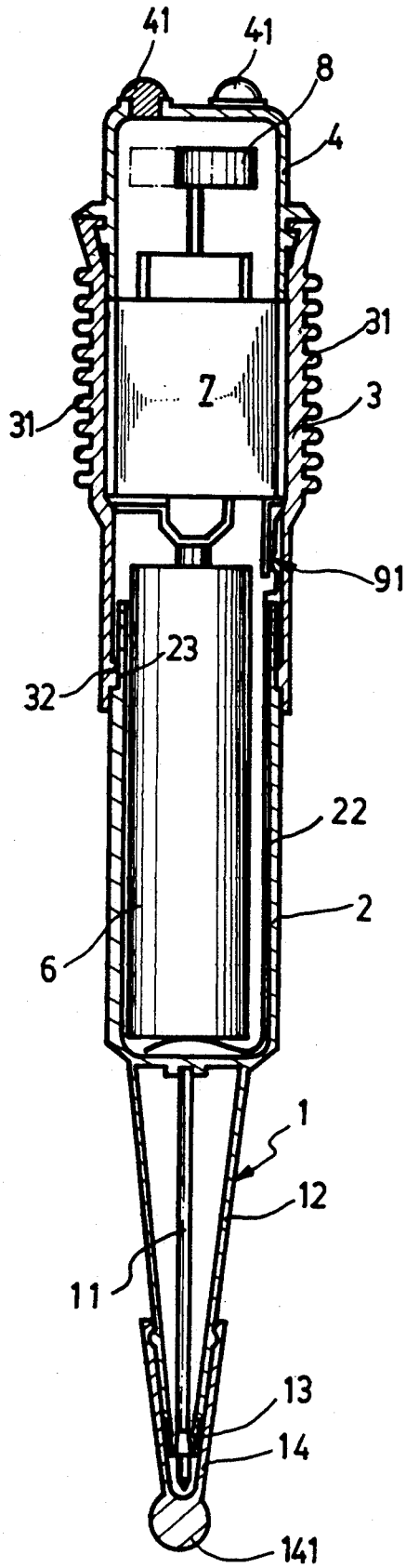
FIG. 3 is a cross section thereof in longitudinal direction.

Referring to FIGS. 2 and 3, the pen unit 1 is consisted of a refill 11, a casing 12, a socket 13, and a bottom cap 14. The refill 11 is replaceably fastened in the casing 12 by the socket 13 through a screw joint. The bottom cap 14 has a bottom end terminated to a stimulating ball 141 for spot massaging. The casing 12 is longitudinally fastened to the lower barrel 2 at the bottom. The lower barrel 2 has a battery chamber 21 on the inside, which receives a battery 6, an elongated conductive strip 22 attached to the inside surface and extended from the bottom out of the top edge thereof, and two angled slots 23 on two opposite locations adjacent to the top edge thereof. The rotary upper barrel 3 has two opposite inward projecting rods 32 respectively inserted in the angled slots 23 and alternatively positioned between two opposite limits for contact switch 9 on/off control (this mechanism can be achieved by regular techniques and therefore no further detailed description is needed). As the rotary upper barrel 3 was positioned at one limit, a contact 91 on the rotary upper barrel 3 is electrically connected to the conductive strip 22 on the lower barrel, therefore the contact switch 9 is "ON". On the contrary, as the rotary upper barrel 3 was positioned at the other limit, the contact 91 is electrically disconnected from the conductive strip 22, and therefore the contact switch 9 is "OFF". A motor 7 is disposed inside the rotary upper barrel 3 to drive an eccentric wheel 8. Once the contact switch 9 was switched on, the motor 7 is turned on to rotate the eccentric wheel 8. The rotary upper barrel 3 further comprises a plurality of pins 31 around the outside surface thereof. The top cap 4 covers on the rotary upper barrel 3 at the top and has a plurality of headed pins 41 on the top. As the eccentric wheel 9 is rotated by the motor 7 to vibrate the rotary upper barrel 3, the pins 31 on the rotary upper barrel 3 and the headed pins 41 on the top cap 4 are respectively reciprocated in two different directions perpendicular to each other for rubbing part of the body alternatively.

What is claimed is:

1. An apparatus comprising a pen unit covered with a detachable bottom cap, an upper barrel, a lower barrel longitudinally connected between said pen unit and said upper barrel, and a top cap fastened to said upper barrel at the top, wherein said pen unit has a replaceable refill covered by said detachable bottom cap, said detachable bottom cap having a bottom end terminated to a stimulating ball for spot massaging, said lower barrel having a battery disposed on the inside, said upper barrel having a motor and an eccentric wheel on the inside, a clip on the outside and a plurality of pins around an outside surface thereof for massaging, said motor being connected to said battery by a switch means, said eccentric wheel being driven by said motor to vibrate said upper barrel and said top cap, said top cap having a plurality of headed pins raised from a stop surface thereof and vibrated by said eccentric wheel for massaging.

* * * * *